United States Patent [19]

Comeaux et al.

[11] Patent Number: 4,490,240

[45] Date of Patent: Dec. 25, 1984

[54] REMOVAL OF CORRODANTS FROM NMP SOLVENT BY CONTACTING WITH SACRIFICIAL METAL

[75] Inventors: Roy V. Comeaux, Baytown, Tex.; Milton D. Leighton, Florham Park; Douglas G. Ryan, Rockaway, both of N.J.

[73] Assignee: Exxon Research and Engineering Co., Florham Park, N.J.

[21] Appl. No.: 527,241

[22] Filed: Aug. 29, 1983

[51] Int. Cl.[3] ..... C10G 29/04; C10G 1/04

[52] U.S. Cl. ..... 208/47; 208/326

[58] Field of Search ..... 208/47, 326

[56] References Cited

U.S. PATENT DOCUMENTS

| | | | |
|---|---|---|---|
| 2,316,931 | 4/1943 | Brandt | 208/47 |
| 2,846,354 | 8/1958 | Holm et al. | 208/47 |
| 3,531,538 | 9/1970 | Duerksen et al. | 260/674 |
| 3,980,449 | 9/1976 | Zetlmeisl et al. | 44/68 |
| 4,294,689 | 10/1981 | Sequeira, Jr. et al. | 208/326 |
| 4,297,150 | 10/1981 | Foster et al. | 208/47 |
| 4,396,492 | 8/1983 | Bardasz | 208/47 |

FOREIGN PATENT DOCUMENTS 867276 3/1971 Canada .

2088850A 6/1982 United Kingdom .

OTHER PUBLICATIONS

"Metallic Preparation for Stabilizing the Lubricating and Anti-Corrosion Action of Oils", Barannik, et al., Zashch Met. 1976 12 (3) 336-9 (abstract).

"Stability and Corrosion Activity of Dichloromethanes", Borisova, Mater. Korroz Svarka 1975, 162-6 (abstract).

Encyclopedia of Chemical Technology, 3rd Ed., vol. 14, pp. 573-575.

*Primary Examiner*—Delbert E. Gantz
*Assistant Examiner*—Chung K. Pak
*Attorney, Agent, or Firm*—Joseph J. Allocca

[57] ABSTRACT

Corrosion of the process equipment in solvent extraction units utilizing N methyl-2-pyrrolidone as the selective extraction solvent is significantly reduced by means of a sacrificial metal contacting zone or bed containing a metal or metal alloy with a higher electro chemical potential than the metals used in the extraction unit vessels and lines. Preferred sacrificial metals are magnesium, zinc, calcium, barium, and strontium, most preferably magnesium, as metal strips, shavings, ribbons, sponge, filings, chips, blocks, bricks, etc.

4 Claims, 2 Drawing Figures

REMOVAL OF CORRODANTS FROM NMP SOLVENT BY CONTACTING WITH SACRIFICIAL METAL

DESCRIPTION OF THE INVENTION

Selective N methyl-2-pyrrolidone (NMP) solvent extraction processes are plagued by process equipment corrosion problems. It has been discovered that this corrosion can be significantly reduced by contacting the NMP streams with a sacrificial metal in a contacting zone or bed containing a metal or metal alloy which possesses an electrochemical potential higher than that of the metal used in the construction of the process equipment, including reaction/extraction vessels, solvent recovery vessels, solvent handling lines, cooling vessels, etc. Preferred sacrificial metals for use in those process plants wherein the processing equipment is constructed of carbon steel or stainless steel are magnesium, zinc, calcium, barium, strontium, preferably magnesium. These sacrificial metals may be employed in any convenient form including bars, rods, ribbons, strips shavings, sponge, filings, chips, donuts, beads, nodules, blocks, bricks, sheets, etc. The sacrificial metal can be inserted into the NMP recovery stream at any convenient location, preferably at a point in the recovery stream wherein said stream is predominately NMP. The sacrificial metal can even be inserted as a large solid block or sheet in the flash zone of a tower at turnaround intervals. No special precautions need be taken as to the conditions under which the NMP stream is contacted with or passed over or through the sacrificial metal. It is preferred, however, that the sacrificial metal be located at a point in the solvent recovery stream wherein the temperature of the NMP recovery stream is elevated, about 250° to 600° F., preferably about 400° to 600° F. Consequently, the preferred location for placement of the sacrificial metal is in the NMP recovery overheads stream wherein the temperature of the stream is about 525° F., and the NMP stream is preferably in the form of a vapor just starting to condense.

DETAILED DESCRIPTION OF THE FIGURES

Figure 1:
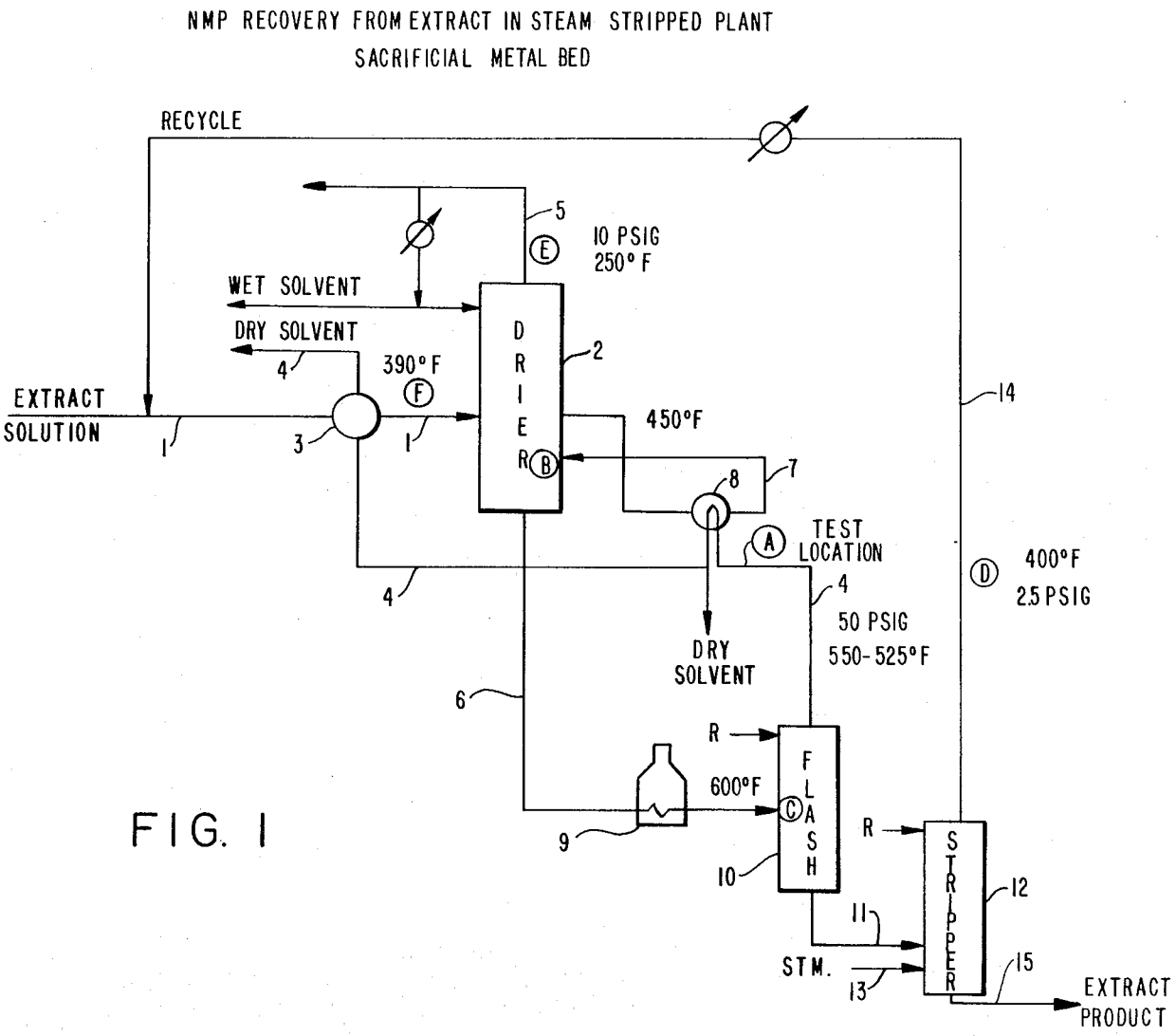
FIGS. 1 and 2 constitute schematics of typical NMP solvent extractive plants showing the various vessels and lines constituting such plants. Those places where sacrificial metal contacting zones or beds can be advantageously located are identified by A–F and A–C respectively in the figures. One or more of such zones or beds can be used as required. Preferably, the sacrificial metal will be located at the point designated A in FIG. 1, the flash tower overhead stream. Second choice would be locating a sheet of the sacrificial metal in the flash zone of the drier tower or the high pressure flash tower.

FIG. 1 presents a schematic of NMP recovery from extract in a steam stripped plant. Extract from the extraction process is fed via line (1) to drier (2). It has been preheated in heater (3) by indirect heat exchange therein with dry solvent in line (4). In drier (2) the extract is dewatered yielding an overheads fraction, line (5), consisting primarily of water (which is eventually recombined with the NMP for use in the extraction zone [not shown]) and an extract solvent fraction, line (6). The extract from drier (2) in line 7 is heated by means of heat exchange, in unit (8) with dry solvent overheads in line (4). Extract/solvent from the drier (2), via line (6), is passed through a heater (furnace 9) and sent to flash tower (10) wherein the solvent is flashed off as overheads (line 4) and the extract is recovered via line (11) and sent to a stripper (12) wherein any residual solvent is stripped off using steam (line 13). The residual solvent is recovered from the stripper (12) via line (14) for recycle to the solvent recovery process while the extract product is recovered via line (15).

In this steam stripping scheme the sacrificial metal contacting zone or bed can be located at a number of sites. In the experiment presented below the sacrificial metal was located at site (A) on the dry solvent overheads line (line 4 in the figure) from the flash zone. At location (A) the steam is in the vapor form at about 525° F. Alternate locations are site (B) in the drier at the heated extract/solvent stream inlet for line (7), wherein the stream is in the vapor/liquid form at about 450° F. Site (C) is in the flash tower at the solvent inlet wherein the stream is in the vapor/liquid form at about 600° F. Site (D) is in the overheads line (14) from the stripper wherein the stream is in the vapor form at about 400° F. Site (E) is on the overheads line (5) from the drier wherein the stream is in the water rich vapor form at about 250° F. Site (F) is on the extract/solvent feed line (1) (leading to the drier) wherein the stream is in the liquid form at about 390° F.

Figure 2:
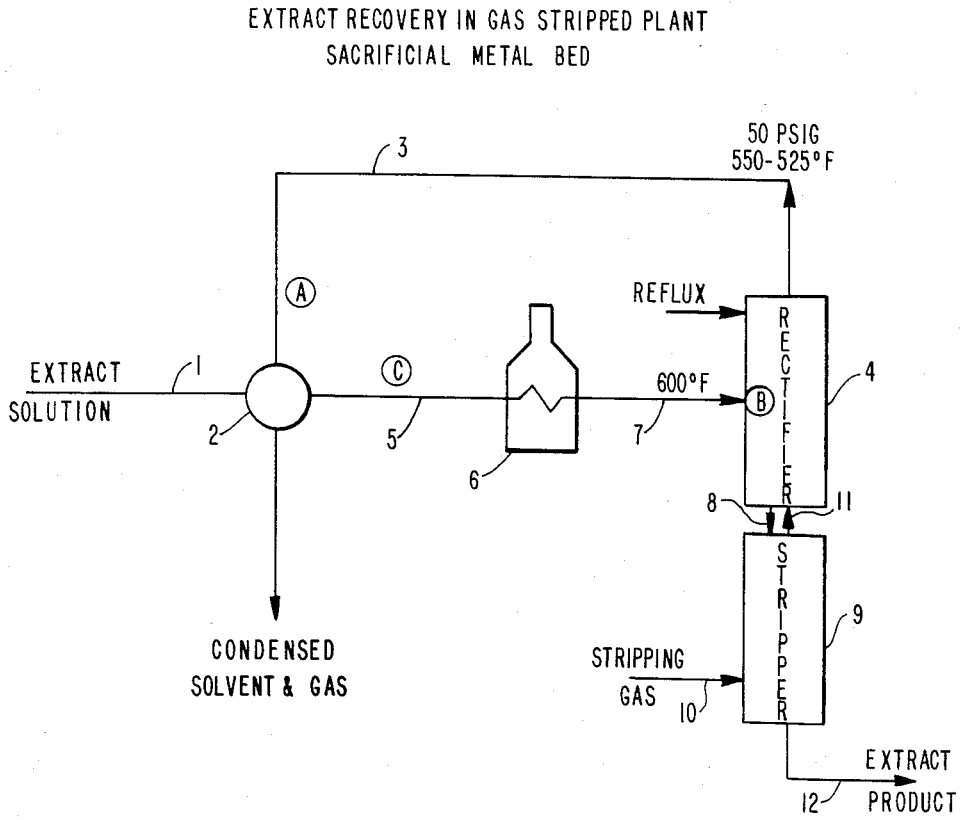

FIG. 2 is a schematic of NMP recovery from extract in a gas stripped plant. Extract/solvent stream in line (1) passes through exchanger (2) wherein it is heated by indirect contact with dry solvent in line (3) coming from the rectifier (4). The heated extract/solvent from heater (2) is sent via line (5) to furnace heater (6) and thence via line (7) to rectifier (4). From the rectifier dry solvent is recovered via line (3) and an extract/solvent stream is recovered via line (8) and sent to the stripper (9). In stripper (9) a stripping gas stream (line 10) is used to strip off residual solvent which is sent via line 11 back to the rectifier. An extract product stream is recovered via line (12) from the stripper. In a gas stripped plant the sacrificial metal can be preferably located at site (A) in the dry solvents overhead line (line 3 of the figure) from the rectifier, wherein the stream is in the vapor form at about 525° F. Alternatively, the sacrificial metal can be at site (B) in the rectifier at the hot extract/solvent inlet wherein the stream is in the vapor/liquid form at about 600° F. or at site (C) on the extract/solvent line (line 5) leading to the furnace heater wherein the stream is in the liquid state at about 480° F.

EXAMPLE

At an NMP solvent extraction plant, all cooling water exchangers were repaired or replaced to eliminate water in leakage. A test bed of magnesium chips in a 6 inch diameter by 2 foot long vessel was installed on a small slip stream of hot NMP vapors (~525° F.) coming from the solvent flash tower overheads (site A in FIG. 1). The NMP vapor was permitted to contact the magnesium chips for a number of days such that the total volume of NMP flowing over the magnesium bed was at least twice the inventory of NMP in the system, after which time the test bed was opened and examined. It was observed that a large portion of the magnesium had been consumed. Measurement of pH of the circulating NMP before and after the magnesium bed was installed revealed an increase of about 1 to 1.5 pH units, presumably resulting from removal of strong acids which had built up over several months and were recycling in the NMP stream. The magnesium salts produced were presumably withdrawn from the system in the extract product and not recycled. Corrosion of the vessels and lines making up the plant ceased.

What is claimed is:

1. A method for arresting the corrosion in selective N-methyl-pyrrolidone (NMP) solvent extraction process plants by use of a sacrificial metal of a higher electrochemical potential than that of the metals used in the construction of the plant, wherein the NMP solvent stream is contacted with said sacrificial metal.

2. The method of claim 1 wherein the sacrificial metal is selected from the group consisting of magnesium, zinc, calcium, barium, and strontium.

3. The method of claim 2 wherein the sacrificial metal is magnesium.

4. The method of claims 1, 2, or 3 wherein the NMP is contacted with the sacrificial metal at a temperature of about 250° to 600° F.

* * * * *